US006857845B2

(12) United States Patent
Stabley et al.

(10) Patent No.: US 6,857,845 B2
(45) Date of Patent: Feb. 22, 2005

(54) SYSTEM AND METHOD FOR DETECTING ROTATING STALL IN A CENTRIFUGAL COMPRESSOR

(75) Inventors: Robert Edward Stabley, Dallastown, PA (US); Gregory Keith Beaverson, York, PA (US); James Edwin Bender, York Haven, PA (US)

(73) Assignee: York International Corporation, York, PA (US)

( * ) Notice: Subject to any disclaimer, the term of this patent is extended or adjusted under 35 U.S.C. 154(b) by 4 days.

(21) Appl. No.: 10/641,277

(22) Filed: Aug. 14, 2003

(65) Prior Publication Data

US 2004/0037693 A1 Feb. 26, 2004

Related U.S. Application Data

(60) Provisional application No. 60/405,374, filed on Aug. 23, 2002.

(51) Int. Cl.[7] ..... F01D 25/04

(52) U.S. Cl. ..... 415/1; 415/118; 415/914

(58) Field of Search ..... 415/1, 118, 914; 416/1, 35, 42, 61, 500

(56) References Cited

U.S. PATENT DOCUMENTS

| | | | |
|---|---|---|---|
| 4,573,358 | A | 3/1986 | Luongo |
| 4,581,900 | A | 4/1986 | Lowe et al. |
| 4,895,026 | A | 1/1990 | Tada |
| 4,967,550 | A | 11/1990 | Acton et al. |
| 4,971,516 | A | 11/1990 | Lawless et al. |
| 5,005,353 | A | 4/1991 | Acton et al. |
| 5,097,711 | A | 3/1992 | Rozelle et al. |
| 5,141,391 | A | 8/1992 | Acton et al. |
| 5,165,849 | A | 11/1992 | Nakagawa et al. |
| 5,310,309 | A | 5/1994 | Terasaki et al. |
| 5,448,881 | A | 9/1995 | Patterson et al. |
| 5,541,857 | A | 7/1996 | Walter et al. |
| 5,586,857 | A | 12/1996 | Ishii et al. |

(List continued on next page.)

FOREIGN PATENT DOCUMENTS

| | | |
|---|---|---|
| WO | WO 97/00381 | 1/1997 |

*Primary Examiner*—Ninh H. Nguyen
(74) *Attorney, Agent, or Firm*—Brian T. Sattizahn; McNees Wallace & Nurick LLC

(57) ABSTRACT

A system and method is provided for detecting and controlling rotating stall in the diffuser region of a centrifugal compressor. The process begins with the detection or sensing of acoustic energy associated with the onset of rotating stall. A pressure transducer is placed in the gas flow path downstream of the impeller, preferably in the compressor discharge passage or the diffuser, to measure the sound or acoustic pressure phenomenon. Next, the signal from the pressure transducer is processed either using analog or digital techniques to determine the presence of rotating stall. Rotating stall is detected by comparing the detected energy amount, which detected energy amount is based on the measured acoustic pressure, with a predetermined threshold amount corresponding to the presence of rotating stall. Finally, an appropriate corrective action is taken to change the operation of the centrifugal compressor in response to the detection of rotating stall.

41 Claims, 5 Drawing Sheets

U.S. PATENT DOCUMENTS 5,594,665 A 1/1997 Walter et al.
5,618,160 A 4/1997 Harada et al.
5,679,900 A 10/1997 Smulders
5,683,223 A 11/1997 Harada et al.
5,726,891 A 3/1998 Sisson et al.
5,746,062 A 5/1998 Beaverson et al.
5,784,300 A 7/1998 Neumeier et al.
5,851,103 A 12/1998 Harada et al.
5,894,736 A 4/1999 Beaverson et al.
5,915,917 A * 6/1999 Eveker et al. ..... 415/1
5,984,625 A 11/1999 Murray et al.
6,010,303 A 1/2000 Feulner
6,036,432 A 3/2000 Sishtla et al.
6,092,029 A 7/2000 Bently
6,098,010 A 8/2000 Krener et al.
6,139,262 A 10/2000 Ravidranath
6,195,982 B1 3/2001 Gysling et al.
6,298,718 B1 10/2001 Wang
6,354,071 B2 3/2002 Tegel et al.
6,536,284 B2 * 3/2003 Bonanni ..... 73/660

* cited by examiner

SYSTEM AND METHOD FOR DETECTING ROTATING STALL IN A CENTRIFUGAL COMPRESSOR

CROSS-REFERENCE TO RELATED APPLICATIONS

This application claims the benefit of U.S. Provisional Application No. 60/405,374 filed Aug. 23, 2002.

BACKGROUND OF THE INVENTION

The present invention relates generally to the detection of rotating stall in a centrifugal compressor. More specifically, the present invention relates to systems and methods of detecting rotating stall in the diffuser portion of a centrifugal compressor by sensing acoustic energy changes in the discharge from the compressor.

Rotating stall in a centrifugal compressor can occur in the rotating impeller or rotor of the compressor or in the stationary diffuser of the compressor downstream from the impeller. The frequencies of the energy associated with rotating stall are typically within a common range of values whether the rotating stall is occurring in the impeller region (impeller rotating stall) or in the diffuser region (diffuser rotating stall). In both cases, the presence of rotating stall can adversely affect performance of the compressor and/or system. However, impeller rotating stall is typically of greater interest because it can affect impeller reliability, especially in axial flow compressors such as aircraft engines, while diffuser rotating stall typically impacts the overall sound and vibration levels of a system.

Some techniques for detecting and correcting impeller rotating stall use a plurality of sensors circumferentially positioned adjacent to the rotating impeller. The sensors are used to detect disturbances at individual locations. The disturbances are then compared to values at other locations or values corresponding to optimal operating conditions. Often, very complicated computations are performed to determine precursors to the onset of impeller rotating stall. Once impeller rotating stall is detected, some corrective actions include bleeding discharge gas back to the suction inlet of the compressor or modifying suction inlet flow angles using baffles or varying the position of the vanes.

One example of a technique for detecting impeller rotating stall in an axial flow compressor is in U.S. Pat. No. 6,010,303 (the '303 patent). The '303 patent is directed to the prediction of aerodynamic and aeromechanical instabilities in turbofan engines. An instability precursor signal is generated in real-time to predict engine surge, stall or blade flutter in aeropropulsion compression systems for turbofan engines which utilize multistage axial flow compressors. Energy waves associated with aerodynamic or aeromechanical resonances in a compression system for a turbofan engine are detected and a signal indicative of the frequencies of resonance is generated. Static pressure transducers or strain gauges are mounted near or on the fan blades to detect the energy of the system. The real-time signal is band pass filtered within a predetermined range of frequencies associated with an instability of interest, e.g. 250–310 Hz. The band pass signal is then squared in magnitude. The squared signal is then low pass filtered to form an energy instability precursor signal. The low pass filter provides an average of the sum of the squares of each frequency. The precursor signal is then used to predict and prevent aerodynamic and aeromechanical instability from occurring in a turbofan engine. One drawback of this technique is that it is only for the detection of impeller rotating stall in an axial flow compressor and does not discuss diffuser rotating stall.

Mixed flow centrifugal compressors with vaneless radial diffusers can experience diffuser rotating stall during some part, or in some cases, all of their intended operating range. Typically, diffuser rotating stall occurs because the design of the diffuser is unable to accommodate all flows without some of the flow experiencing separation in the diffuser passageway. Diffuser rotating stall results in the creation of low frequency sound energy or pulsations in the gas flow passages at fundamental frequencies that are generally less than the rotating frequency of the compressor's impeller. This low frequency sound energy and its associated harmonics propagate downstream through the compressor gas passageways into pipes, heat exchangers and other vessels. The low frequency sound energy or acoustic disturbances can have high magnitudes and are undesirable because the presence of acoustic disturbances may result in the premature failure of the compressor, its controls, or other associated parts/systems.

Therefore, what is needed is a system and method for detecting and correcting rotating stall in the diffuser of a centrifugal compressor by sensing a change in the acoustic energy in the gas stream around the diffuser and then taking action to modify the compression process to avoid or remedy those conditions that produce significant amounts of rotating stall noise in the diffuser.

SUMMARY OF THE INVENTION

The present invention can use either analog or digital circuits (or a combination of the two) to detect the presence of rotating stall in the diffuser. The circuits process a signal from a pressure transducer located in the diffuser or downstream from the diffuser using a high pass filter with a break frequency of 10 Hz to be able to analyze the AC (or dynamic) fluctuations from the pressure transducer. Next, a low pass filter is used to attenuate frequencies above a break frequency of 300 Hz. The operation of the low pass and the high pass filter can be considered to be similar to a band pass filter with a bandwidth of 10 to 300 Hz. The 10–300 Hz range is important because AC components in this range increase in amplitude as the operation of the centrifugal compressor moves into rotating stall.

The output of the low pass filter or band pass filter is processed with an active full wave active rectifier to obtain a signal which is only positive and includes a composite of AC components superimposed on a DC component. The composite signal yields a DC (or average) value, which DC value is required for subsequent processing, that increases in magnitude as the stall frequencies energies increase in amplitude. A low pass filter follows the full wave active rectifier. The low pass filter has a very low cutoff frequency of approximately 0.16 Hz, to pass only the DC component of the waveform because the DC portion of this waveform provides a representation of the stall fluctuation amplitude of the pressure transducer. The DC component or signal is then compared to a threshold value to determine the presence of rotating stall. The threshold value for determining rotating stall is dependent on the amount of gain applied to the signal from the pressure transducer and the amount of rotating stall that can be tolerated in the diffuser before correction is required.

Alternatively, the present invention can utilize a DSP programmed to perform a Fast Fourier Transform (FFT) in real time on the digitized output of the pressure transducer for detecting rotating stall. The use of the FFT permits stall to be detected directly in the frequency domain rather than in the time domain as described above. The FFT is applied to the signal from the pressure transducer to obtain a series of frequencies and energy levels. Some of the frequencies from the FFT can be discarded that are outside of the range of interest (10–300 Hz). Next, the energy levels between 10–300 Hz are summed to generate a summed energy level value. The energy levels associated with the impeller's rotating speed can be discarded for a more accurate value. The summed energy level value will then be compared to a threshold value to determine the presence of rotating stall. Also, rather than summing the spectral components, stall could be detected by looking for peaks in the spectrum to exceed a pre-determined threshold.

One embodiment of the present invention is directed to a method for correcting rotating stall in a radial diffuser of a centrifugal compressor. The method includes the step of measuring a value representative of acoustical energy associated with rotating stall in a radial diffuser of a centrifugal compressor. The method further includes the steps of filtering the measured value with a bandpass filter to obtain a filtered value, rectifying the filtered value with a full wave rectifier to obtain a rectified value, and filtering the rectified value with a low pass filter to obtain a stall energy component. Finally, the method includes the steps of comparing the stall energy component with a predetermined value to determine rotating stall in the radial diffuser, wherein rotating stall is present in the radial diffuser when the stall energy component is greater than the predetermined value, and sending a control signal to the centrifugal compressor to adjust an operational configuration of the centrifugal compressor in response to a determination of rotating stall.

Another embodiment of the present invention is directed to a method for detecting rotating stall in a centrifugal compressor. The method includes the steps of measuring a value representative of acoustical energy associated with rotating stall in a centrifugal compressor and performing a Fast Fourier Transform on the measured value to obtain a plurality of frequencies and corresponding energy values. The method also includes the steps of selecting frequencies and corresponding energy values associated with rotating stall from the plurality of frequencies and energy values and summing the corresponding energy values of the selected frequencies associated with rotating stall. Finally, the method includes the step of detecting rotating stall in the centrifugal compressor by comparing the summed energy values to a predetermined threshold value, wherein rotating stall is present in the centrifugal compressor when the summed energy values are greater than the predetermined threshold value.

Still another embodiment of the present invention is directed to a system for correcting rotating stall in a radial diffuser of a centrifugal compressor. The system includes a sensor configured to measure a parameter representative of acoustical energy associated with rotating stall in a radial diffuser of a centrifugal compressor and generate a sensor signal corresponding to the measured parameter. The system also includes a high pass filter having a break frequency of 10 Hz, a first low pass filter having a break frequency of 300 Hz, and a full wave rectifier. The high pass filter is configured to receive the sensor signal and output a high pass filtered signal. The first low pass filter is configured to receive the high pass filtered signal from the high pass filter and output a low pass filtered signal. The full wave rectifier is configured to receive the low pass filtered signal and output a rectified signal. The system also includes control circuitry and a second low pass filter configured to receive the rectified signal and output a stall energy component signal. The control circuitry is configured to determine rotating stall in the radial diffuser using the stall energy component signal and output a control signal to adjust an operational configuration of the centrifugal compressor in response to a determination of rotating stall.

A further embodiment of the present invention is directed to a system for correcting rotating stall in a radial diffuser of a centrifugal compressor. The system includes a sensor configured to measure a parameter representative of acoustical energy associated with rotating stall in a radial diffuser of a centrifugal compressor and generate a sensor signal corresponding to the measured parameter. An analog to digital converter converts the sensor signal to a digital signal. The system also includes a digital signal processor that receives the digital signal from the digital to analog converter. The digital signal processor includes a high pass filter having a break frequency of 10 Hz, a first low pass filter having a break frequency of 300 Hz, a full wave rectifier, and a second low pass filter. The high pass filter is configured to receive the digital signal and output a high pass filtered signal. The first low pass filter is configured to receive the high pass filtered signal from the high pass filter and output a low pass filtered signal. The full wave rectifier is configured to receive the low pass filtered signal and output a rectified signal. The second low pass filter is configured to receive the rectified signal and output a stall energy component signal having only the average value of the rectified signal. A digital to analog converter is used to convert the stall energy component signal to an analog signal. Finally, the system has control circuitry configured to determine rotating stall in the radial diffuser using the analog signal and output a control signal to adjust an operational configuration of the centrifugal compressor in response to a determination of rotating stall.

One advantage of the present invention is that it uses a simplified package of electronics and hardware to detect rotating stall in the diffuser portion of the compressor.

Another advantage of the present invention is that the determination of rotating stall can be used to make decisions on possible techniques to reduce or eliminate the rotating stall noise generated in the diffuser.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
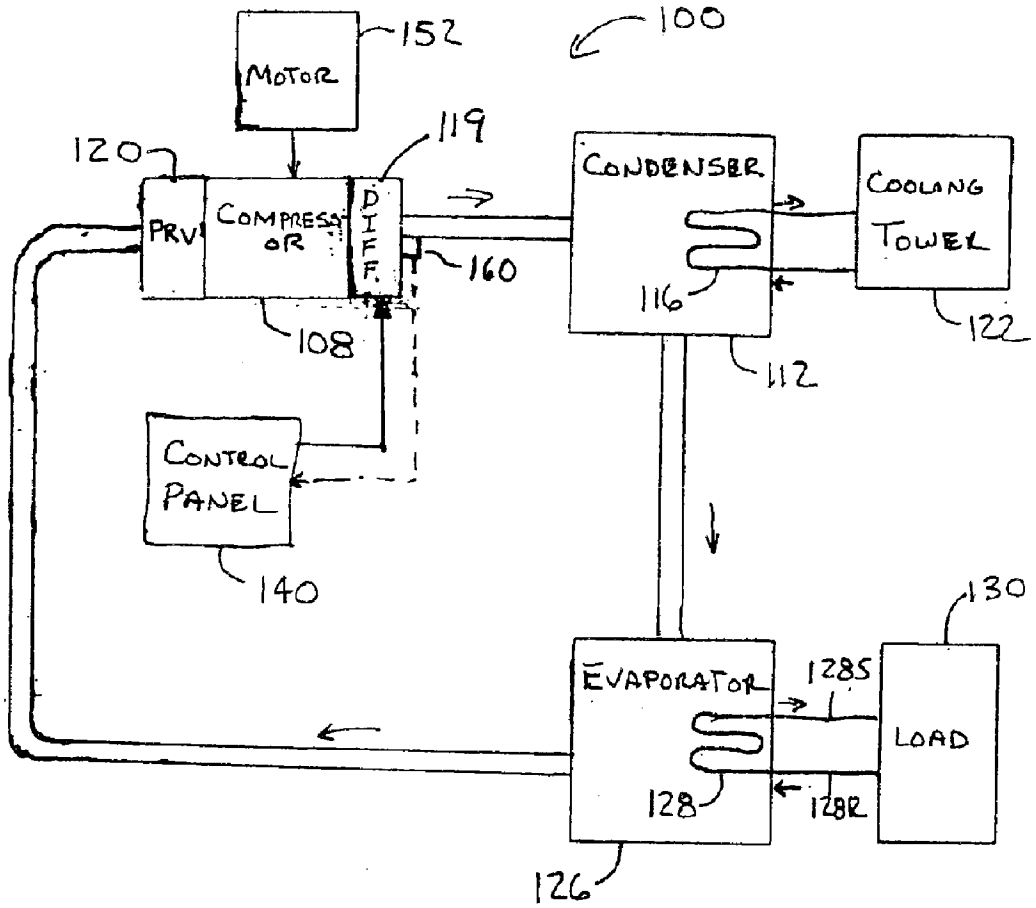
FIG. 1 illustrates schematically a refrigeration system of the present invention.

A general system to which the invention can be applied is illustrated, by means of example, in FIG. 1. As shown, the HVAC, refrigeration or liquid chiller system 100 includes a compressor 108, a condenser 112, a water chiller or evaporator 126, and a control panel 140. The control panel 140 receives input signals from the system 100 that indicate the performance of the system 100 and transmits signals to components of the system 100 to control the operation of the system 100. The conventional liquid chiller system 100 includes many other features that are not shown in FIG. 1. These features have been purposely omitted to simplify the drawing for ease of illustration.

Compressor 108 compresses a refrigerant vapor and delivers the vapor to the condenser 112 through a discharge line. The compressor 108 is preferably a centrifugal compressor; however, the present invention can be used with any type of compressor that can experience a rotating stall condition or operate at a flow where rotating stall can occur. The refrigerant vapor delivered to the condenser 112 enters into a heat exchange relationship with a fluid, e.g. air or water, and undergoes a phase change to a refrigerant liquid as a result of the heat exchange relationship with the fluid. The condensed liquid refrigerant from condenser 112 flows to an evaporator 126. In a preferred embodiment, the refrigerant vapor in the condenser 112 enters into the heat exchange relationship with water, flowing through a heat-exchanger coil 116 connected to a cooling tower 122. The refrigerant vapor in the condenser 112 undergoes a phase change to a refrigerant liquid as a result of the heat exchange relationship with the water in the heat-exchanger coil 116.

The evaporator 126 can preferably include a heat-exchanger coil 128 having a supply line 128S and a return line 128R connected to a cooling load 130. The heat-exchanger coil 128 can include a plurality of tube bundles within the evaporator 126. A secondary liquid, which is preferably water, but can be any other suitable secondary liquid, e.g. ethylene, calcium chloride brine or sodium chloride brine, travels into the evaporator 126 via return line 128R and exits the evaporator 126 via supply line 128S. The liquid refrigerant in the evaporator 126 enters into a heat exchange relationship with the secondary liquid in the heat-exchanger coil 128 to chill the temperature of the secondary liquid in the heat-exchanger coil 128. The refrigerant liquid in the evaporator 126 undergoes a phase change to a refrigerant vapor as a result of the heat exchange relationship with the secondary liquid in the heat-exchanger coil 128. The vapor refrigerant in the evaporator 126 exits the evaporator 126 and returns to the compressor 108 by a suction line to complete the cycle. While the system 100 has been described in terms of preferred embodiments for the condenser 112 and evaporator 126, it is to be understood that any suitable configuration of condenser 112 and evaporator 126 can be used in system 100, provided that the appropriate phase change of the refrigerant in the condenser 112 and evaporator 126 is obtained.

At the input or inlet to the compressor 108 from the evaporator 126, there are one or more pre-rotation vanes or inlet guide vanes 120 that control the flow of refrigerant to the compressor 108. An actuator is used to open the pre-rotation vanes 120 to increase the amount of refrigerant to the compressor 108 and thereby increase the cooling capacity of the system 100. Similarly, an actuator is used to close the pre-rotation vanes 120 to decrease the amount of refrigerant to the compressor 108 and thereby decrease the cooling capacity of the system 100.

To drive the compressor 108, the system 100 includes a motor or drive mechanism 152 for compressor 108. While the term "motor" is used with respect to the drive mechanism for the compressor 108, it is to be understood that the term "motor" is not limited to a motor but is intended to encompass any component that can be used in conjunction with the driving of motor 152, such as a variable speed drive and a motor starter. In a preferred embodiment of the present invention the motor or drive mechanism 152 is an electric motor and associated components. However, other drive mechanisms such as steam or gas turbines or engines and associated components can be used to drive the compressor 108.

Figure 2:
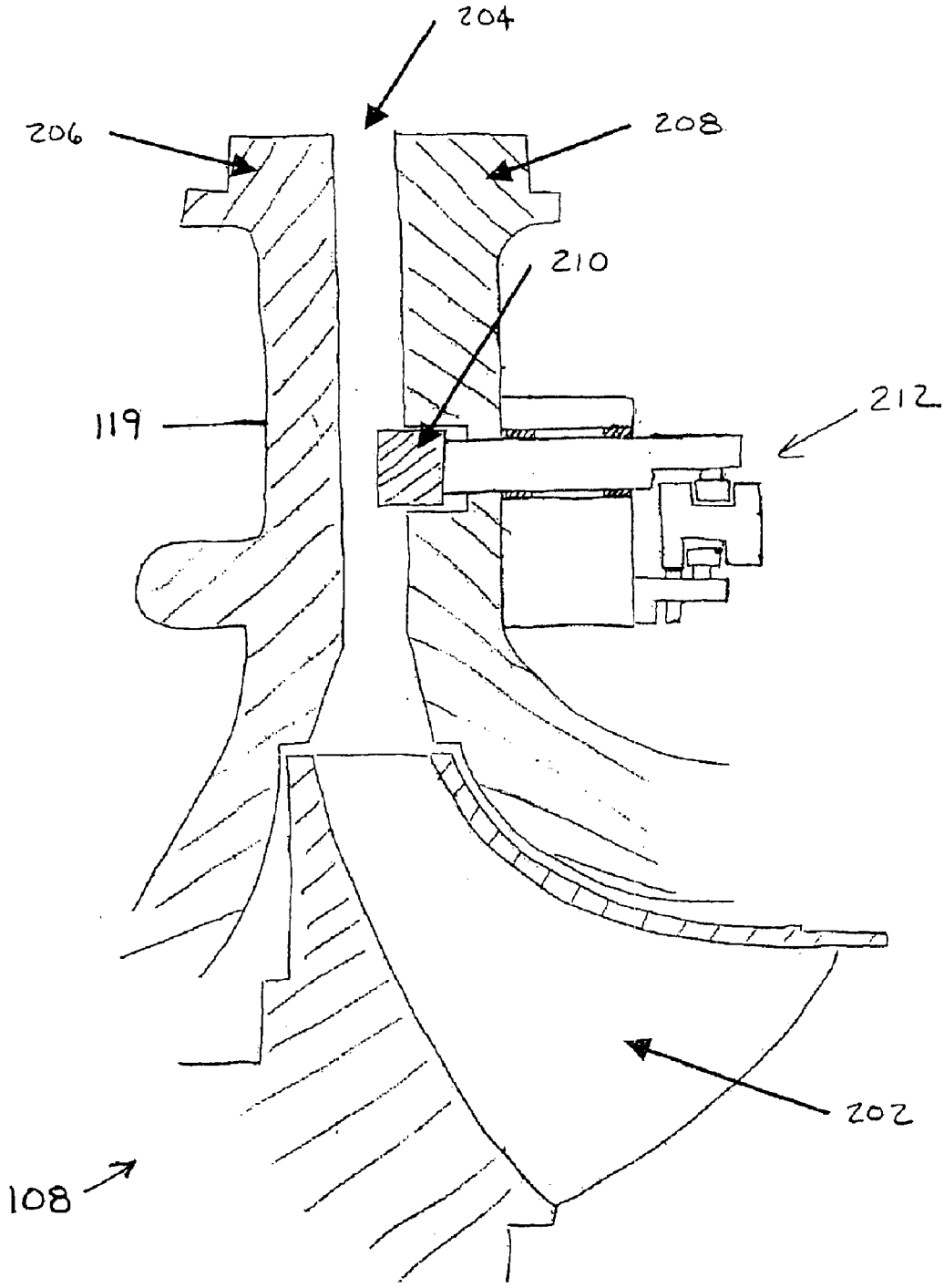
FIG. 2 illustrates a partial sectional view of a centrifugal compressor and diffuser of the present invention.

FIG. 2 illustrates a partial sectional view of the compressor 108 of a preferred embodiment of the present invention. The compressor 108 includes an impeller 202 for compressing the refrigerant vapor. The compressed vapor then passes through a diffuser 119. The diffuser 119 is preferably a vaneless radial diffuser and has a diffuser space 204 formed between a diffuser plate 206 and a nozzle base plate 208 for the passage of the refrigerant vapor. The nozzle base plate 208 is configured for use with a diffuser ring 210. The diffuser ring 210 is used to control the velocity of refrigerant vapor that passes through the diffuser passage 202. The diffuser ring 210 can be extended into the diffuser passage 202 to increase the velocity of the vapor flowing through the passage and can be retracted from the diffuser passage 202 to decrease the velocity of the vapor flowing through the passage. The diffuser ring 210 can be extended and retracted using an adjustment mechanism 212.

Referring back to FIG. 1, the system 100 also includes a sensor 160 for sensing an operating condition of system 100 that can be used to determine a rotating stall condition in the diffuser 119. The sensor 160 can be placed anywhere in the gas flow path downstream of the impeller 202 of the compressor 108. However, the sensor 160 is preferably positioned in the compressor discharge passage (as shown schematically in FIG. 1) or the diffuser 119. The sensor 160 is preferably a pressure transducer for measuring an acoustic or sound pressure phenomenon, however, other types of sensors may also be employed. For example, an accelerometer can be used to measure stall related vibration. The pressure transducer generates a signal that is representative of the stall energies present in the discharge line. The signal from the sensor 160 is transferred over a line to the control panel 140 for subsequent processing to determine and correct rotating stall in the diffuser 119.

The output of sensor 160 used to measure the energy associated with rotating stall is preferably conditioned so as to differentiate between stall-related acoustic energy and energy due to other sources of sound or vibration. In one embodiment of the present invention, the conditioning can occur by simply measuring the amount of energy within a range of frequencies that includes the fundamental stall frequency and its major harmonics. In other conditioning schemes, some frequencies within the stall-related region that are not related to stall could be sensed and removed from the analysis in order to enhance the ability to detect the presence of only rotating stall energies. The conditioned output signal from sensor 160 can be used in conjunction with the process discussed below to take corrective action to avoid significant amounts of rotating stall noise being generated by the compressor 108.

The strength and frequency content of the sound energy associated with rotating stall has been studied extensively. As the operation of a compressor moves into the rotating stall region, there is an increase, within a predetermined frequency band of approximately 10–300 Hz, of the AC components of the sound energy. It has also been observed that the onset of significant amounts of rotating stall is rather abrupt. Thus, a frequency analysis of a signal representative of the sound energy present in the gas flow shows that a sudden increase in the strength or magnitude of the stall related energies in the 10–300 Hz frequency band is indicative of the compressor moving into a rotating stall condition.

Figure 3:
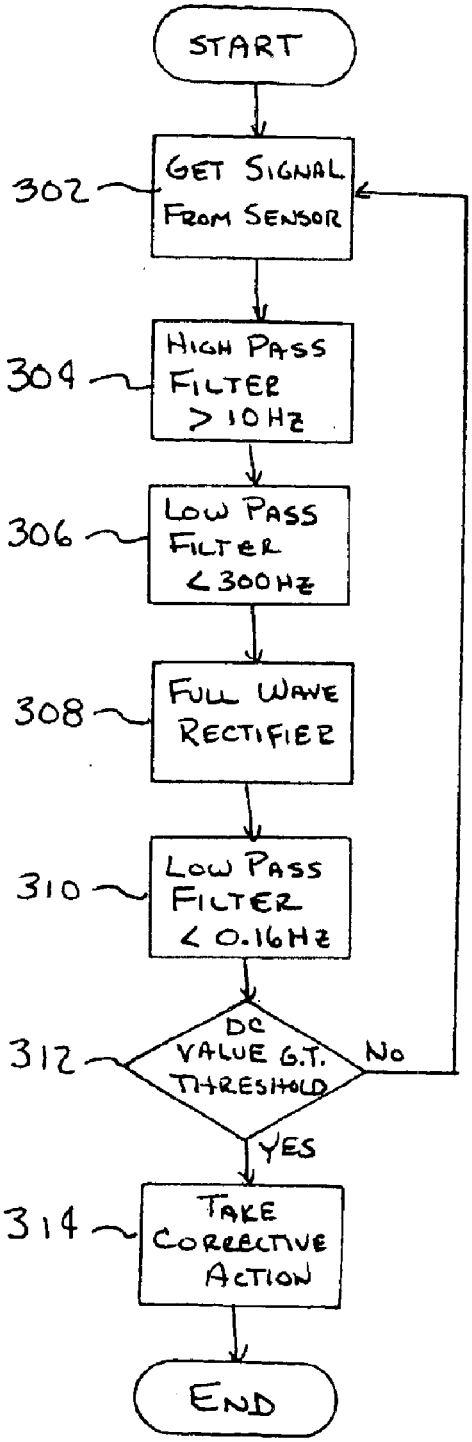
FIG. 3 illustrates a flow chart for detecting and correcting a rotating stall condition in one embodiment of the present invention.

FIG. 3 illustrates one process for detecting and correcting rotating stall in the diffuser 119 of the compressor 108. The process can be implemented on the control panel 140 using analog components (a portion of which is shown schematically in FIG. 4), digital components (a portion of which is shown schematically in FIG. 5) or a combination of analog and digital components (not shown). The process begins at step 302 with the control panel 140 receiving a signal from sensor 160. As discussed above, the signal received from sensor 160 corresponds to an amount of energy which may indicate the onset of rotating stall. The direct measurement of the sound pressure phenomenon with the pressure transducer 160 in the preferred embodiment provides a more reliable indication of the existence of rotating stall and avoids other, non-stall related acoustic signals. For example, if the vibration of the compressor 108 is used to detect the onset of rotating stall, any vibration due to the unbalance of the compressor's motor 152, or gear, or impeller 202 which may be in the same frequency range as the rotating stall noise can provide signals of such magnitudes that they may interfere with the ability to detect only the rotating stall noise related components.

In step 304, the signal from sensor 160 is passed through a high pass filter. In determining the presence of rotating stall, the AC fluctuations from sensor 160 represent the signal of interest and the DC portion of the signal is not required for the detection of rotating stall. Therefore, the high pass filter is used to remove the DC portion of the signal. The high pass filter preferably has a break frequency of about 10 Hz. The break frequency can be set to any appropriate value that removes the DC portion of the signal while leaving a sufficient AC portion of the signal for analysis depending the desired accuracy of the detection. In one embodiment of the present invention, the high pass filter can include a single pole RC high pass filter which results in an input signal attenuation of 0.707 at 10 Hz which decreases below this frequency to zero at DC (0 Hertz). In other embodiments of the present invention, higher order high pass filters can be used for filtering the signal from the sensor 160.

After passing through the high pass filter and a gain amplifier (if necessary), the signal is then passed through a low pass filter in step 306. The low pass filter is used to attenuate frequencies above a break or cutoff frequency, which break frequency defines the upper frequency level associated with rotating stall conditions. In a preferred embodiment of the present invention, the upper frequency or break frequency associated with rotating stall energy is about 300 Hz. In one embodiment of the present invention, a six order Butterworth low pass filter is used to eliminate frequency components above the stall frequency range (approximately 10–300 Hz) not related to rotating stall which could result in a false indication of rotating stall. In other embodiments of the present invention, different order, preferably larger order, low pass filters can be used to remove the higher frequencies.

In another embodiment of the present invention, steps 304 and 306 can be combined into a single step. In this embodiment, instead of using both a high pass filter (step 304) and a low pass filter (step 306), a band pass filter can be used to remove both the DC component and the higher frequencies from the sensor signal. The band pass filter preferably has a frequency range of about 10–300 Hz, which is the equivalent frequency range after the high pass and low pass filters of steps 304 and 306.

After passing through the low pass filter in step 306, the signal is passed through an active full wave rectifier in step 308. The active full wave rectifier is used to convert or "flip" the negative portions of the AC signal to an equivalent positive value while having no impact on the positive portion of the AC signal. The full wave rectified signal has only positive components and includes a composite of AC components superimposed on DC components. The composite signal yields an average (or DC) value which increases in magnitude as the energies at the stall frequencies increase in amplitude.

In step 310, the signal from the active full wave rectifier is passed through a low pass filter having a low cutoff frequency to pass only the DC component. As discussed above, the DC component portion of the full wave rectified waveform provides a representation of the stall fluctuation amplitude of the sensor 160, thus only the DC component of the signal is necessary for the detection of rotating stall. In one embodiment of the present invention, the low pass filter can have a cutoff frequency of 0.16 Hz. However, this frequency is not critical and other cutoff frequencies, e.g., 0.1 Hz, can be used for passing only the DC component.

Figure 4:
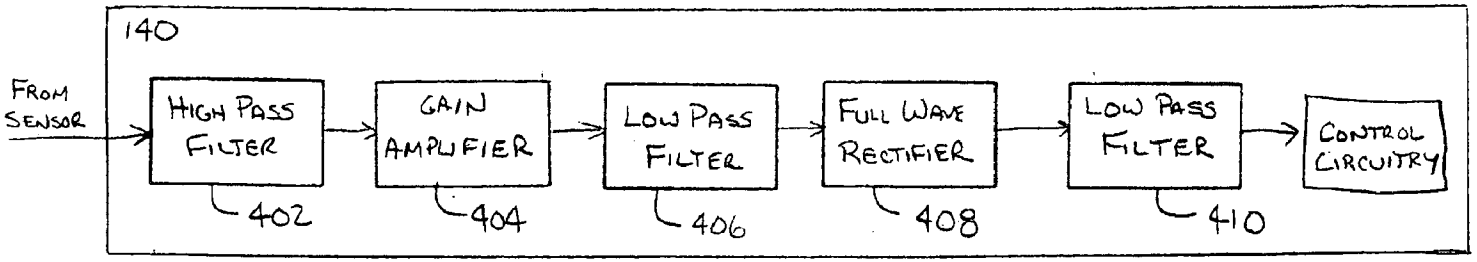
FIG. 4 illustrates schematically one embodiment of an analog circuit for use with the present invention.

FIG. 4 illustrates schematically an analog circuit for completing steps 304–310. A high pass filter 402 receives the signal from sensor 160, which high pass filter 402 filters the signal as described with regard to step 304. If necessary, a gain amplifier 404 can be used to boost or strengthen the output from the high pass filter 402. The gain amplifier 404 can be used to boost the signal from the high pass filter 402 to an appropriate value for comparison to a threshold value representative of a rotating stall condition. A low pass filter 406 receives a signal from the gain amplifier 404 or the high pass filter 402 and filters the signal as described above with regard to step 306. An active full wave rectifier 408 is used to rectify the signal from the low pass filter 406 as described above with regard to step 308. An active full wave rectifier 408 is preferred in order to eliminate DC offsets that may be created by using a full wave bridge rectifier. Finally, the full wave rectified signal from the active full wave rectifier 408 is filtered using a low pass filter 410, which filters the signal as described above with regard to step 310 and sends a signal to control circuitry, which control circuitry may include a microprocessor and/or comparator, for subsequent processing of the signal from the low pass filter 410.

Figure 5:
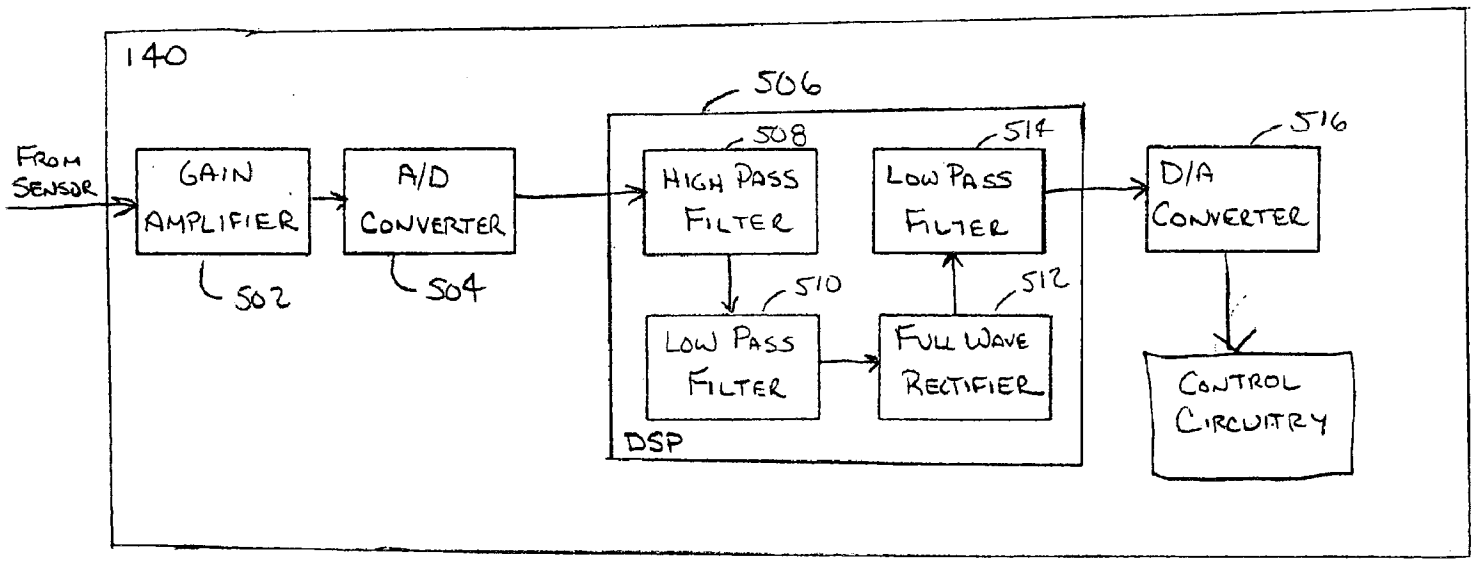
FIG. 5 illustrates schematically one embodiment of a digital circuit for use with the present invention.

FIG. 5 illustrates schematically a digital circuit for completing steps 304–310. If necessary, a gain amplifier 502 can be used to boost or strengthen the signal from sensor 160 to an appropriate value for comparison to a threshold value representative of a rotating stall condition. The signal from gain amplifier 502 or the sensor 160 is then passed through an A/D converter 504 to convert the analog signal to a digital signal. The digital signal from the A/D converter 504 is then preferably provided to digital signal processor (DSP) circuitry 506 for completing steps 304–310. In DSP circuitry 506, a high pass filter 508 receives the signal from A/D converter 504, which high pass filter 508 filters the signal as described with regard to step 304. A low pass filter 510 receives a signal from the high pass filter 508 and filters the signal as described with regard to step 306. A full wave rectifier 512 is used to rectify the signal from the low pass filter 510 as described with regard to step 308. The full wave rectified signal from the full wave rectifier 512 is filtered using a low pass filter 514, which filters the signal as described with regard to step 310. Finally, the signal from the low pass filter 514 of DSP circuitry 506 is then passed through a D/A converter 516, which generates an analog signal and sends the analog signal to control circuitry, which may include a microprocessor and/or comparator, for subsequent processing of the analog signal.

Referring back to FIG. 3, the low pass filtered signal having only a DC component from step 310 is then compared with a threshold value to determine the presence of rotating stall in step 312. As discussed above, the amplitude of the DC component increases as the compressor 108 moves into a rotating stall condition. Thus, the presence of rotating stall can be detected by determining when the DC component or voltage exceeds a threshold value. The threshold value can be set to a value equal to a multiple of the normal operating value for the DC component, i.e., the value of the DC component when there is no rotating stall. In a preferred embodiment of the present invention, the threshold value can be two to six times the normal operating value. For example, if the normal operating values for the DC component are 0.2–0.4 VDC, then the threshold values for detecting rotating stall can be between 0.8–1.2 VDC. The values for normal operation and threshold are dependent on the amount of gain that is applied to the signal. In other words, when more gain that is applied to a signal, the normal operating value will be larger and the threshold value will be larger. If rotating stall is not detected in step 312, the process returns to step 302 and a new signal from sensor 160 is obtained for processing.

If rotating stall is detected in step 312, then corrective action is taken to correct the rotating stall condition in step 314. Corrective action can include, but is not limited to, narrowing the width of the diffuser space 204 of the radial diffuser 119, shortening the length of the radial diffuser 119, or increasing flow to the compressor 108 at the compressor inlet or downstream of the impeller 202. In a preferred embodiment of the present invention, upon the detection of rotating stall the control panel 140 sends a signal to the diffuser 119 and specifically, adjustment mechanism 212 of the diffuser 119 to adjust the position of the diffuser ring 210 to correct the rotating stall condition. The diffuser ring 210 is inserted into the diffuser space 204 to narrow the width of the diffuser space 204 in order to correct the rotating stall condition.

Figure 6:
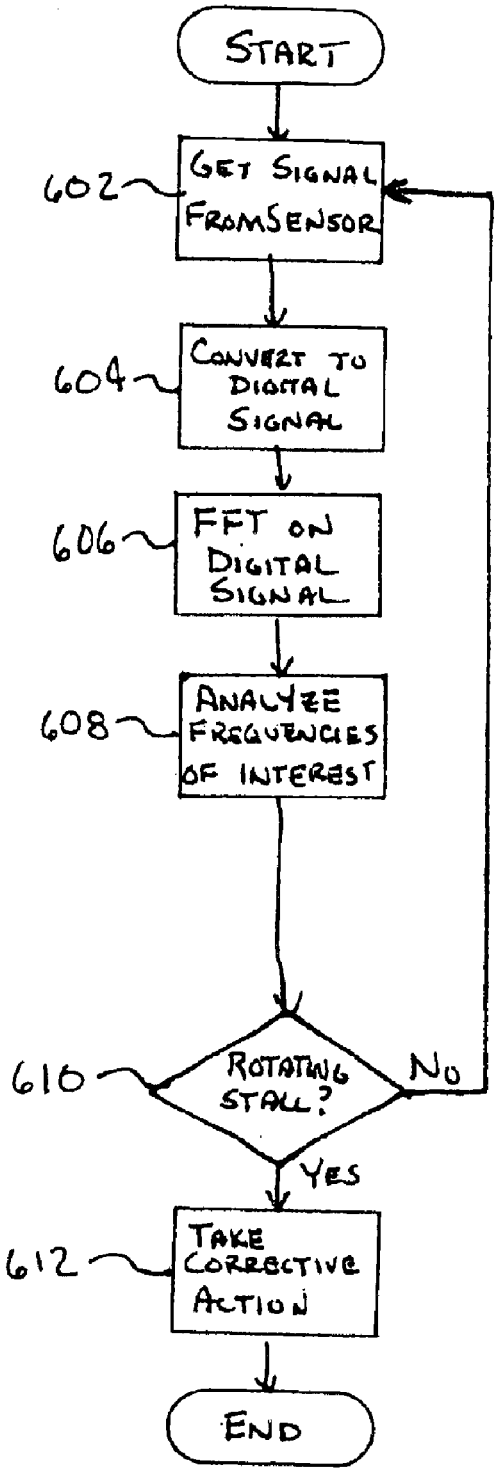
FIG. 6 illustrates a flow chart for detecting and correcting a rotating stall condition in another embodiment of the present invention.

In another embodiment of the present invention, a Fast Fourier Transform (FFT) can be used to detect the presence of rotating stall. FIG. 6 illustrates one process for detecting and correcting rotating stall in the diffuser 119 of the compressor 108 using an FFT. The process begins with the control panel 140 receiving a signal from sensor 160 in step 602 and converting the signal from sensor 160 into a digital signal in step 604 preferably using an A/D converter. Next, in step 606, a FFT is applied to the digital signal from step 604 to generate a plurality of frequencies and energy values. The FFT is preferably programmed into a DSP chip on the control panel 140 and can be executed in real time. The FFT DSP chip is preferably configured to perform any necessary operations or calculations such as multiplies and accumulations to complete the FFT. The application of an FFT to the digitized input signal from sensor 160 permits rotating stall to be detected directly in the frequency domain rather than in the time domain as described above with regard to FIG. 3.

Since only a particular range of fundamental frequencies are of interest in the detection of rotating stall, approximately 10–300 Hz as discussed in greater detail above, only those particular frequencies of interest have to be analyzed in the frequency domain in step 608, i.e. the frequencies not associated with rotating stall can be discarded. Further, the particular range of fundamental frequencies of interest are always equal to or below the rotating frequency of the compressor's impeller 202, thus, the analysis of rotating stall can be limited to an appropriate range of interest by considering the compressor's speed. This limitation on the frequency range of interest is beneficial in variable speed drive (VSD) applications, since as the speed of the impeller 202 is reduced, the frequency range of interest becomes narrower and thereby aids in the elimination of extraneous frequencies which would lead to a false detection. Whether or not the compressor is operated in variable speed or fixed speed, frequency components in the FFT associated with rotating stall and its harmonics are kept, while frequency components related to the operating speed of the impeller and its harmonics are removed (set to zero). Also, other non-stall frequencies below the rotating frequency of the compressor's impeller 202 such as electrical interference (60 Hz and harmonics), which may couple through the transducer, are also removed.

After the elimination of extraneous frequencies in step 608, the remaining components or frequencies from the FFT are then summed to determine if the resulting value is within the stall region in step 610. Similar to the detection of rotating stall in step 312, the detection of rotating stall in step 610 is based on the summed or resulting value being greater than a threshold value that defines the stall region. The threshold value can be set to a value equal to a multiple of the normal operating value for the summed or resulting value from the FFT components, i.e. the value of the summed or resulting value from the FFT components when there is no rotating stall. In a preferred embodiment of the present invention, the threshold value can be two to six times the normal operating value. The values for normal operation and threshold are dependent on the strength of the signal that is analyzed and on the amount of amplification that is applied to the signal to enhance signal to noise ratios. In another embodiment of the present invention, rotating stall can be detected by determining if peaks in the remaining frequency spectrum exceed a pre-determined threshold value. If rotating stall is not detected in step 610, the process returns to step 602 and a new signal from sensor 160 is obtained for processing.

If rotating stall is detected in step 610, then corrective action is taken to correct the rotating stall condition in step 612. Corrective action can include, but is not limited to, narrowing the width of the diffuser space 204 of the radial diffuser 119, shortening the length of the radial diffuser 119, or increasing flow to the compressor 108 at the compressor inlet or downstream of the impeller 202. In a preferred embodiment of the present invention, upon the detection of rotating stall the control panel 140 sends a signal to the adjustment mechanism 212 of the diffuser 119 to adjust the position of the diffuser ring 210 to correct the rotating stall condition. The diffuser ring 210 is inserted into the diffuser space 204 to narrow the width of the diffuser space 204 in order to correct the rotating stall condition.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for correcting rotating stall in a radial diffuser of a centrifugal compressor, the method comprising the steps of:

measuring a value representative of acoustical energy associated with rotating stall in a radial diffuser of a centrifugal compressor;

filtering the measured value with a bandpass filter to obtain a filtered value;

rectifying the filtered value with a full wave rectifier to obtain a rectified value;

filtering the rectified value with a low pass filter to obtain a stall energy component;

comparing the stall energy component with a predetermined value to determine rotating stall in the radial diffuser, wherein rotating stall is present in the radial diffuser when the stall energy component is greater than the predetermined value; and sending a control signal to the centrifugal compressor to adjust an operational configuration of the centrifugal compressor in response to a determination of rotating stall.

2. The method of claim 1 wherein the step of measuring a value representative of acoustical energy associated with rotating stall includes the step of measuring an acoustic pressure in the radial diffuser of the centrifugal compressor with a pressure transducer.

3. The method of claim 2 wherein the pressure transducer is positioned in a compressor discharge passageway.

4. The method of claim 1 wherein the step of filtering the measured value with a bandpass filter includes the steps of:

filtering the measured value with a high pass filter having a break frequency of 10 Hz to obtain an intermediate value; and filtering the intermediate value with a low pass filter having a break frequency of 300 Hz.

5. The method of claim 4 wherein the high pass filter is a single pole RC high pass filter and the low pass filter is a six order Butterworth low pass filter.

6. The method of claim 4 further comprising the step of amplifying the intermediate value with a gain amplifier.

7. The method of claim 1 wherein the full wave rectifier is an active full wave rectifier.

8. The method of claim 1 wherein the step of filtering the rectified value with a low pass filter to obtain a stall energy component includes the steps of filtering the rectified value with a low pass filter having a cutoff frequency of 0.16 Hz.

9. The method of claim 1 wherein the predetermined value is a multiple of the stall energy component calculated during normal operation of the centrifugal compressor without rotating stall.

10. The method of claim 9 wherein the predetermined value is 2 to 6 times the value of the stall energy component calculated during normal operation of the centrifugal compressor without rotating stall.

11. The method of claim 1 wherein the step of sending a control signal to the centrifugal compressor includes the step of sending a control signal to the radial diffuser.

12. The method of claim 11 further comprising the step of adjusting a diffuser ring to narrow a width of a diffuser space in the radial diffuser in response to the control signal being sent to the radial diffuser.

13. The method of claim 1 further comprising the step of amplifying the measured value with a gain amplifier.

14. The method of claim 1 further comprising the step of conditioning the measured value to remove acoustical energies not associated with rotating stall.

15. A method for detecting rotating stall in a centrifugal compressor, the method comprising the steps of:

measuring a value representative of acoustical energy associated with rotating stall in a centrifugal compressor;

performing a Fast Fourier Transform on the measured value to obtain a plurality of frequencies and corresponding energy values;

selecting frequencies and corresponding energy values associated with rotating stall from the plurality of frequencies and energy values;

summing the corresponding energy values of the selected frequencies associated with rotating stall; and detecting rotating stall in the centrifugal compressor by comparing the summed energy values to a predetermined threshold value, wherein rotating stall is present in the centrifugal compressor when the summed energy values are greater than the predetermined threshold value.

16. The method of claim 15 wherein the step of measuring a value representative of acoustical energy associated with rotating stall includes the step of measuring an acoustic pressure in a radial diffuser of the centrifugal compressor with a pressure transducer.

17. The method of claim 16 wherein the pressure transducer is positioned in a compressor discharge passageway.

18. The method of claim 15 wherein the step of selecting frequencies and corresponding energy values associated with rotating stall includes the step of selecting frequencies and corresponding energy values in a frequency range of about 10 Hz to about 300 Hz.

19. The method of claim 18 further comprising the step of removing frequencies and corresponding energy values that are not associated with rotating stall from the frequency range of about 10 Hz to about 300 Hz.

20. The method of claim 15 wherein the predetermined threshold value is a multiple of the summed energy values calculated during normal operation of the centrifugal compressor without rotating stall.

21. The method of claim 20 wherein the predetermined threshold value is 2 to 6 times the value of the summed energy values calculated during normal operation of the centrifugal compressor without rotating stall.

22. The method of claim 15 further comprising the steps of:

generating a control signal for a radial diffuser of the centrifugal compressor in response to the detection of rotating stall; and sending the generated control signal to the radial diffuser to alter a configuration of the radial diffuser.

23. The method of claim 22 further comprising the step of adjusting a diffuser ring to narrow a width of a diffuser space in the radial diffuser in response to the generated control signal being sent to the radial diffuser.

24. The method of claim 15 further comprising the step of amplifying the measured value with a gain amplifier.

25. The method of claim 15 further comprising the step of conditioning the measured value to remove acoustical energies not associated with rotating stall.

26. A system for correcting rotating stall in a radial diffuser of a centrifugal compressor, the system comprising:

a sensor, the sensor being configured to measure a parameter representative of acoustical energy associated with rotating stall in a radial diffuser of a centrifugal compressor and generate a sensor signal corresponding to the measured parameter;

a high pass filter having a break frequency of 10 Hz, the high pass filter being configured to receive the sensor signal and output a high pass filtered signal;

a first low pass filter having a break frequency of 300 Hz, the first low pass filter being configured to receive the high pass filtered signal from the high pass filter and output a low pass filtered signal;

a full wave rectifier, the full wave rectifier being configured to receive the low pass filtered signal and output a rectified signal;

a second low pass filter, the second low pass filter being configured to receive the rectified signal and output a stall energy component signal; and control circuitry, the control circuitry being configured to determine rotating stall in the radial diffuser using the stall energy component signal and output a control signal to adjust an operational configuration of the centrifugal compressor in response to a determination of rotating stall.

27. The system of claim 26 wherein the sensor comprises a pressure transducer to measure an acoustic pressure in the radial diffuser of the centrifugal compressor with.

28. The system of claim 27 wherein the pressure transducer is disposed in a discharge passageway of the centrifugal compressor upon installation of the pressure transducer.

29. The system of claim 26 wherein the high pass filter is a single pole RC high pass filter.

30. The system of claim 26 wherein the low pass filter is a six order Butterworth low pass filter.

31. The system of claim 26 further comprising a gain amplifier, the gain amplifier being configured to receive the high pass filtered signal and output an amplified signal to the first low pass filter.

32. The system of claim 26 wherein the full wave rectifier is an active full wave rectifier.

33. The system of claim 26 wherein the second low pass filter has a break frequency of 0.16 Hz.

34. The system of claim 26 wherein:

the control circuitry comprises a comparator to compare the stall energy component signal to a predetermined value;

the control circuitry outputs the control signal in response to the stall energy component signal being greater than the predetermined value; and the predetermined value is a multiple of the stall energy component calculated during normal operation of the centrifugal compressor without rotating stall.

35. The system of claim 34 wherein the predetermined value is 2 to 6 times the value of the stall energy component calculated during normal operation of the centrifugal compressor without rotating stall.

36. A system for correcting rotating stall in a radial diffuser of a centrifugal compressor, the system comprising:

a sensor, the sensor being configured to measure a parameter representative of acoustical energy associated with rotating stall in a radial diffuser of a centrifugal compressor and generate a sensor signal corresponding to the measured parameter;

an analog to digital converter to convert the sensor signal to a digital signal;

a digital signal processor, the digital signal processor receiving the digital signal from the digital to analog converter, and the digital signal processor comprising:

a high pass filter having a break frequency of 10 Hz, the high pass filter being configured to receive the digital signal and output a high pass filtered signal;

a first low pass filter having a break frequency of 300 Hz, the first low pass filter being configured to receive the high pass filtered signal from the high pass filter and output a low pass filtered signal; and a full wave rectifier, the full wave rectifier being configured to receive the low pass filtered signal and output a rectified signal;

a second low pass filter, the second low pass filter being configured to receive the rectified signal and output a stall energy component signal;

a digital to analog converter to convert the stall energy component signal to an analog signal; and control circuitry, the control circuitry being configured to determine rotating stall in the radial diffuser using the analog signal and output a control signal to adjust an operational configuration of the centrifugal compressor in response to a determination of rotating stall.

37. The system of claim 36 wherein the sensor comprises a pressure transducer to measure an acoustic pressure in the radial diffuser of the centrifugal compressor with.

38. The system of claim 37 wherein the pressure transducer is disposed in a discharge passageway of the centrifugal compressor upon installation of the pressure transducer.

39. The system of claim 36 further comprising a gain amplifier, the gain amplifier being configured to receive the measured parameter and output an amplified signal to the analog to digital converter.

40. The system of claim 36 wherein:

the control circuitry comprises a comparator to compare the stall energy component signal to a predetermined value;

the control circuitry outputs the control signal in response to the stall energy component signal being greater than the predetermined value; and the predetermined value is a multiple of the stall energy component calculated during normal operation of the centrifugal compressor without rotating stall.

41. The system of claim 40 wherein the predetermined value is 2 to 6 times the value of the stall energy component calculated during normal operation of the centrifugal compressor without rotating stall.

* * * * *